US010238556B1

(12) United States Patent
Slagerman et al.

(10) Patent No.: US 10,238,556 B1
(45) Date of Patent: Mar. 26, 2019

(54) MULTI-ADJUSTABLE WHEELCHAIR AND FRAME THEREFOR

(71) Applicant: Ki Mobility, Stevens Point, WI (US)

(72) Inventors: Murray G. Slagerman, Rosser (CA); Thomas J. Whelan, Stevens Point, WI (US); Richard E. Schneider, Cheyenne, OR (US)

(73) Assignee: Ki Mobility, LLC, Stevens Point, WI (US)

( * ) Notice: Subject to any disclaimer, the term of this patent is extended or adjusted under 35 U.S.C. 154(b) by 0 days.

(21) Appl. No.: 15/719,154

(22) Filed: Sep. 28, 2017

Related U.S. Application Data

(63) Continuation of application No. 15/209,296, filed on Jul. 13, 2016, now Pat. No. 9,801,766.

(60) Provisional application No. 62/192,027, filed on Jul. 13, 2015.

(51) Int. Cl.
*A61G 5/00* (2006.01)
*A61G 5/10* (2006.01)

(52) U.S. Cl.
CPC ..... *A61G 5/00* (2013.01); *A61G 5/1059* (2013.01)

(58) Field of Classification Search
CPC . A61G 5/00; A61G 5/02; A61G 5/08–5/0891; A61G 5/006; A61G 5/06; A61G 5/061; A61G 5/088; A61G 5/085; A61G 5/0866; A61G 5/1056; A61G 5/1059; A61G 5/1064; A61G 5/107
See application file for complete search history.

(56) References Cited

U.S. PATENT DOCUMENTS

| | | | | |
|---|---|---|---|---|
| 4,245,847 | A * | 1/1981 | Knott | A61G 5/06 280/47.16 |
| 5,244,223 | A | 9/1993 | Uchiyama | |
| 6,851,711 | B2 | 2/2005 | Goertzen | |
| 2003/0197345 | A1* | 10/2003 | Nelson | A61G 5/00 280/250.1 |
| 2005/0236813 | A1* | 10/2005 | Cerreto | A61G 5/08 280/647 |

OTHER PUBLICATIONS

USPTO, Non-Final Office Action, dated Mar. 29, 2017, in related parent application, U.S. Appl. No. 15/206,296, filed Jul. 13, 2016.

* cited by examiner

*Primary Examiner* — Erez Gurari
(74) *Attorney, Agent, or Firm* — Thedford I Hitaffer; Hitaffer & Hitaffer, PLLC

(57) ABSTRACT

A wheelchair frame comprises a base frame having a geometry that is structured and configured to be adjustable about a fixed pivot, wherein the base frame comprises a central frame and frame component that are adjustable via an angular adjustment.

7 Claims, 16 Drawing Sheets

MULTI-ADJUSTABLE WHEELCHAIR AND FRAME THEREFOR

CROSS-REFERENCE TO RELATED APPLICATIONS

This application is a continuation of U.S. application Ser. No. 15/209,296, filed Jul. 13, 2016, which claims the benefit of U.S. Provisional Application No. 62/192,027, filed Jul. 13, 2015, the disclosures of which are incorporated herein by reference.

BACKGROUND OF THE INVENTION

This invention relates in general to wheelchairs and more particularly to adjustable wheelchairs.

Wheelchairs are adapted to meet size requirements of users, seeking to provide a suitable seat height, frame depth, wheelbase and width. Wheelchair frames are commonly either fabricated to a custom specification or adjusted by using components that can be moved relative to a frame.

Custom fabricated frames, often described as rigid frame wheelchairs, have a limitation of not having any adjustment or a very limited range of adjustment. When user changes occur, the frame may not be adaptable to meet future needs. The advantage of the rigid frame is compact size and reduced weight, but specification has to be very accurate and cost of custom fabrication is higher.

Frames with adjustable components, typically for front and rear wheels, provide an over-sized framework that allows mounting brackets to be moved in both a vertical and horizontal range on the frame, allowing the wheelbase to change in length and the frame to be adjusted in height relative to the wheelbase. The limitation of this approach is that additional frame geometry is required to provide range of adjustment, adding size and weight to the wheelchair.

SUMMARY OF THE INVENTION

This invention relates to a frame system design that does not add additional framework structure and still provides a wide range of adjustment of the wheelbase and seat height and provides a lightweight and compact system. A design using a central frame support or base with angle adjustable and length adjustable mounting components for the rear wheel axle and the front frame caster wheels provides a new structure and method for adapting seat frame height relative to the wheels and for adjustment of the wheelbase to provide suitable stability.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
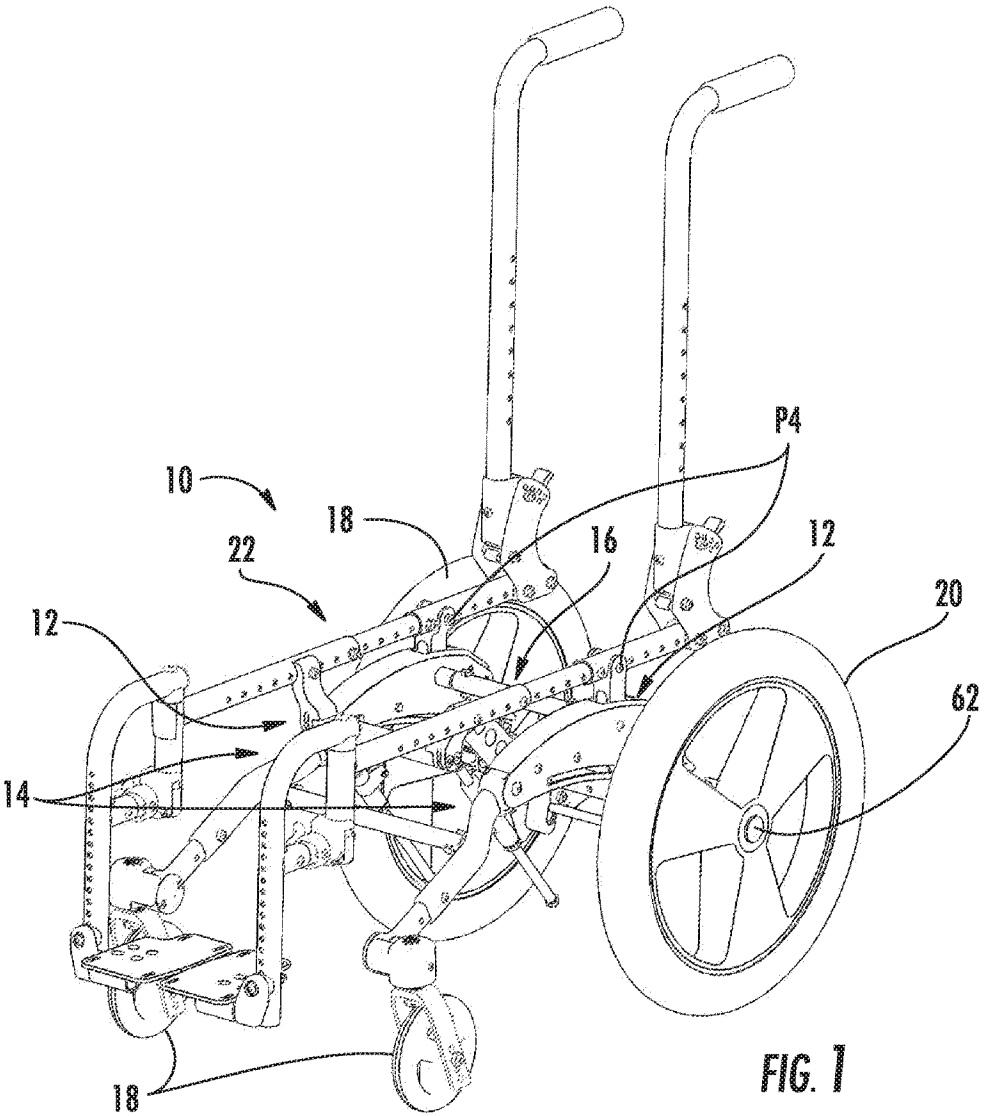
FIG. 1 is a front perspective view of a multi-adjustable wheelchair.
Figure 2:
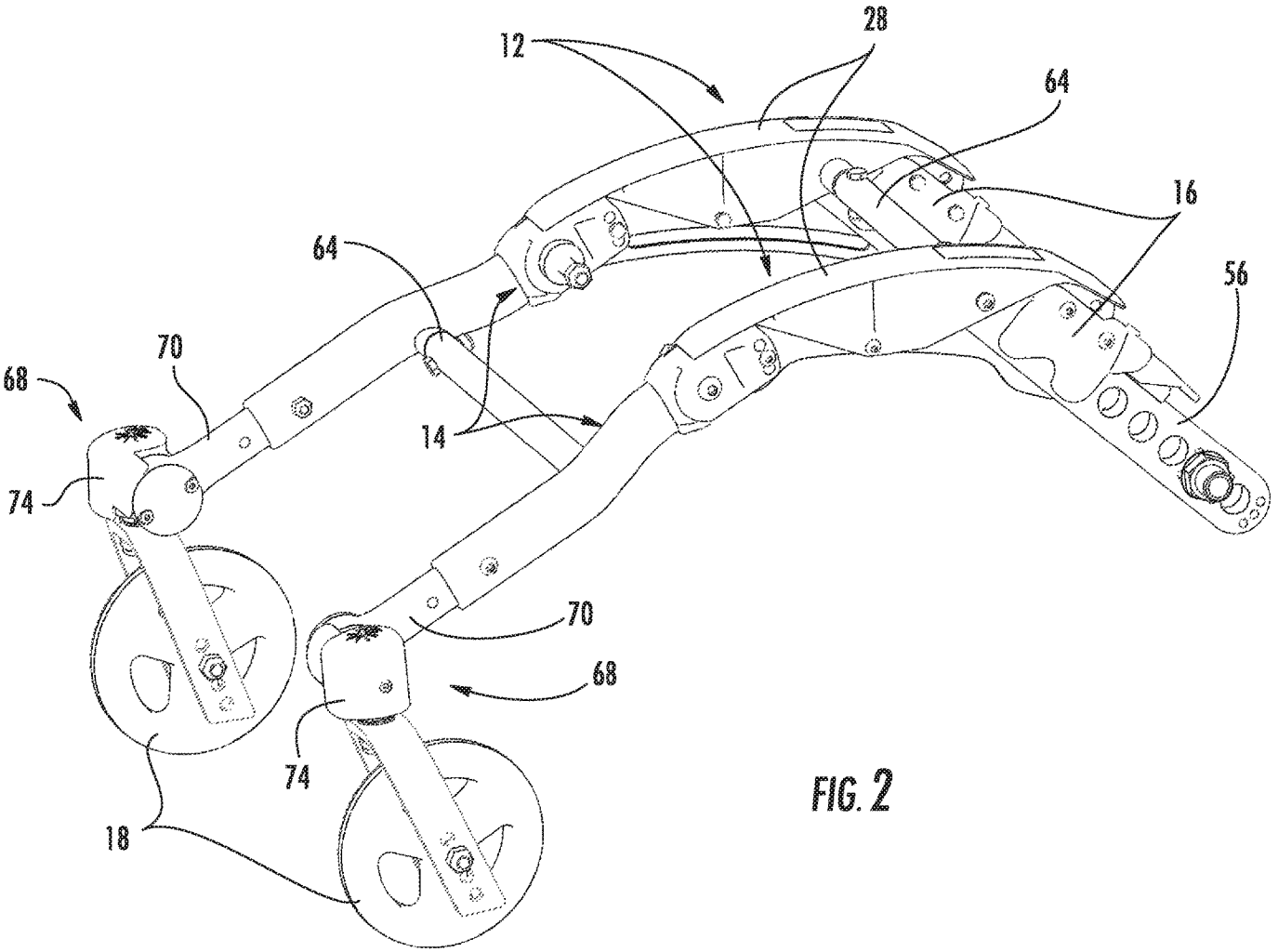
FIG. 2 is an enlarged front perspective view of a central frame of the wheelchair shown in FIG. 1 with adjustable frame components.

Referring now to the drawings, there is illustrated in FIG. 1 a multi-adjustable wheelchair 10 with seat and back panels removed to expose a wheelchair base frame geometry, including a frame and frame components. The wheelchair 10 comprises a central frame 12, which may be comprised of a plate system or other suitable structure. The central frame 12 connects to separately adjustable frame components, including a front frame component 14 (shown in FIG. 2) and a rear frame component 16. The front frame component 14 supports a front caster wheel 18. The rear frame component 16 supports rear wheel 20. The central frame 12 is situated below a seat frame 22.

Figure 7:
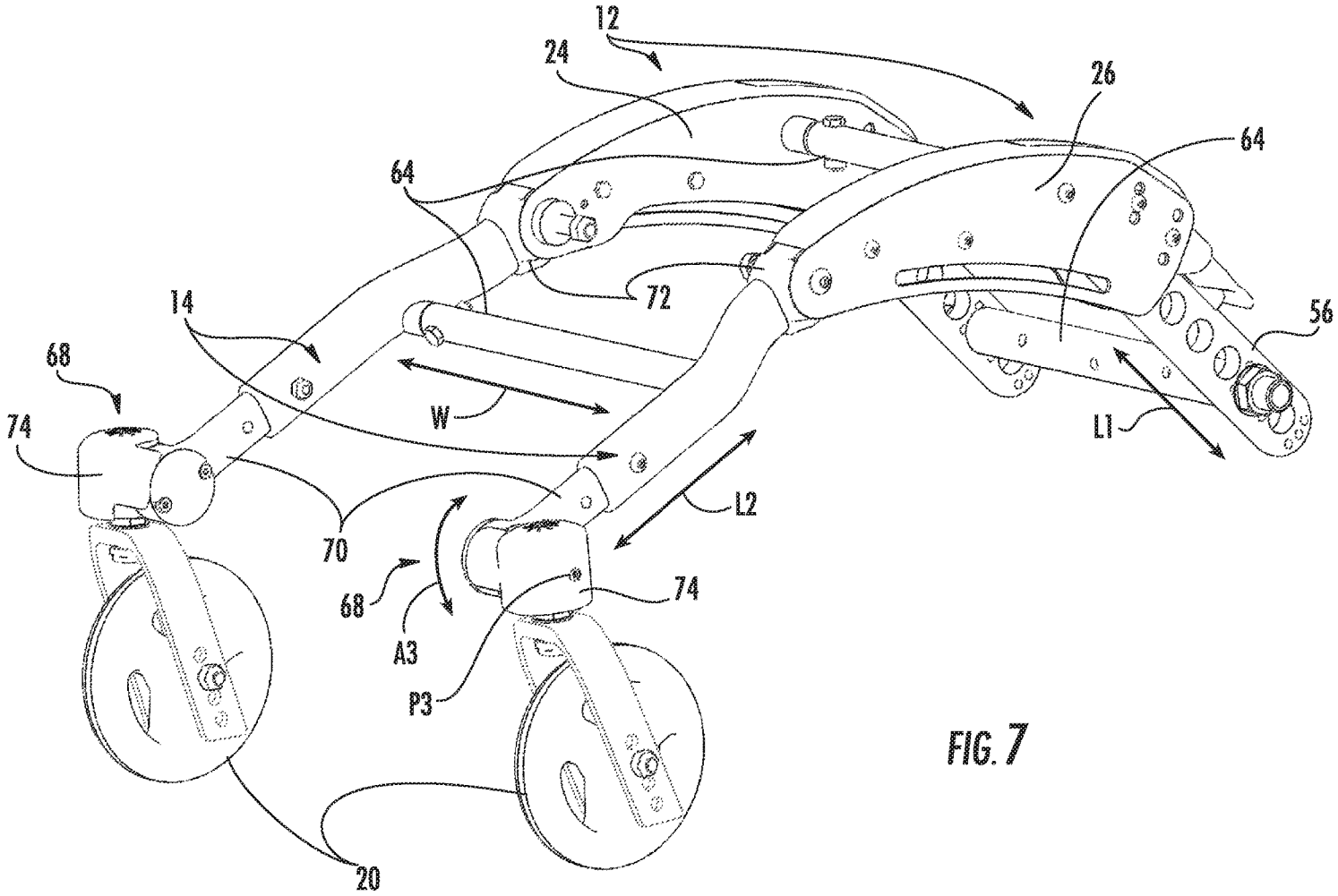
FIG. 7 is a front perspective view of the central frame and adjustable frame components shown in FIG. 4, illustrating various other adjustment capabilities the multi-adjustable wheelchair.

As shown in FIG. 7, an exemplary plate system may comprise inner and outer frame plates 24, 26 and a plate frame cover 28. The central frame 12 need not be limited to the use of an assembly of plates, as shown, but may use other suitable structure, such as a machined central body or an assembly of one or more cast housings.

Figure 3:
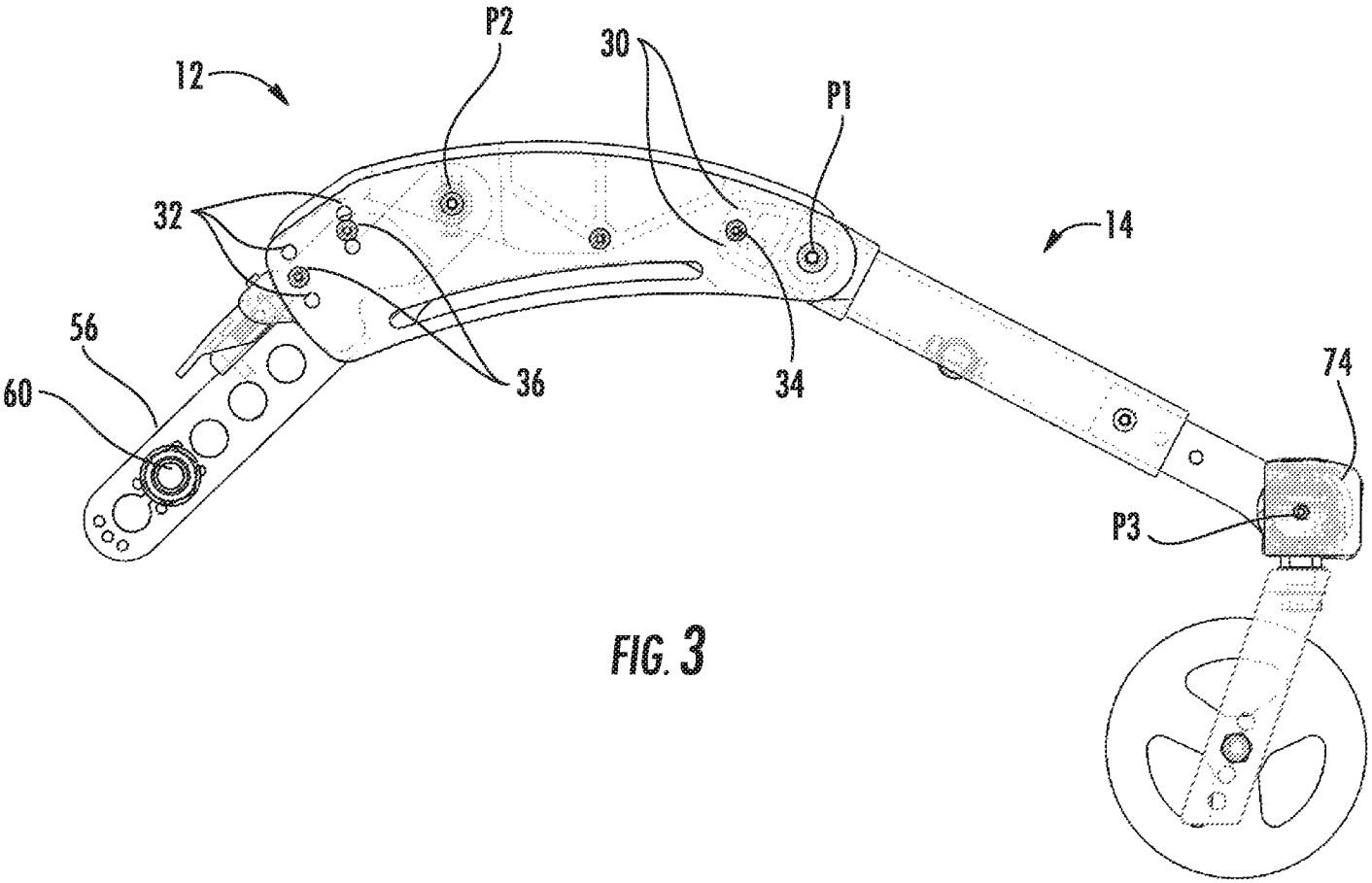
FIG. 3 is a side elevational view of the central frame and adjustable frame components shown in FIG. 2.
Figure 4:
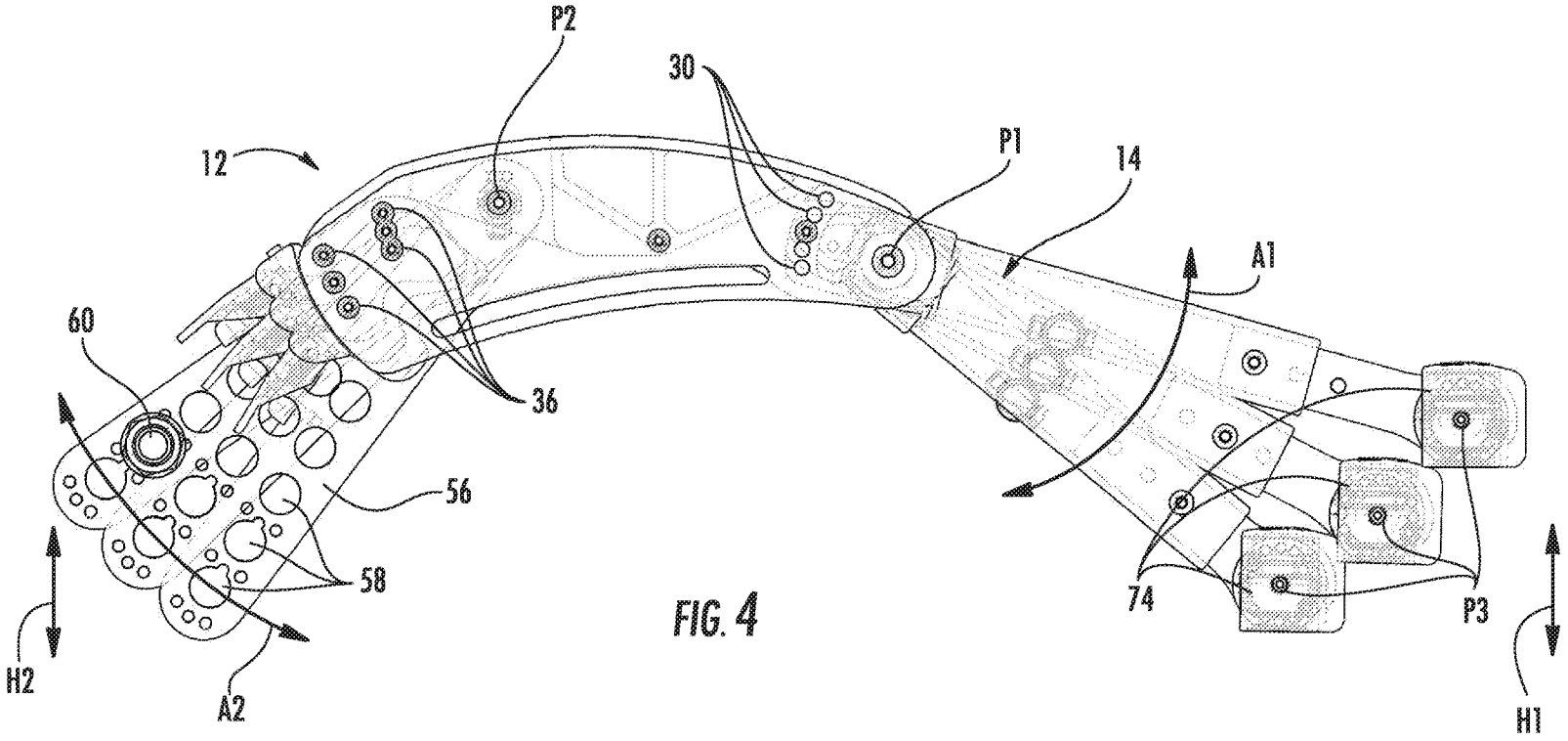
FIG. 4 is a slightly enlarged side elevational view of the central frame and adjustable frame components shown in FIG. 3, further illustrating angular adjustment of the adjustable frame components in relation of the central frame.

As shown in FIGS. 3-4, the front frame component 14 can be independently adjusted angularly with respect to the central frame 12 (e.g., along line A1 when viewing FIG. 4). This permits a change in height of the front of the seat frame 22 (e.g., along line H1 when viewing FIG. 4). Similarly, the rear frame component 16 can be independently adjusted angularly with respect to the central frame 12 (e.g., along line A2 when viewing FIG. 4). This permits a change in the height of the rear of the seat frame 22 (e.g., along line H2 when viewing FIG. 4). Additionally, the angular adjustment provides wheelbase adjustment (i.e. adjustment in the footprint of the wheelchair 10, that is, the point of contact between the front caster wheels 18 and the rear wheels 20 with a supporting surface) in a longitudinal or lengthwise direction.

The front and rear frame components 14, 16 are adjustable in relation to the central frame 12 about pivot points P1, P2. The illustrated embodiment is provided with a plurality of radially placed holes 30, 32 (shown in FIG. 3) in either the central frame 12, or in mounting bracketry that can be aligned to achieve different relative angles. The front and rear frame components 14, 16 can be engaged and locked into position using threaded fasteners 34, 36 (shown in FIG. 3). The illustrated embodiment provides approximately 24 degrees of adjustment in 12 degree intervals. However, other suitable adjustments and/or interval can be provided, as desired. Finer adjustments are capable by providing a plurality of holes in either or both the central frame 12 and the front and rear frame components 14, 16.

The central frame 12 need not use specific pivot points for the angular adjustment, but could use a plurality of holes in the central frame 12 and the front and rear frame components 14, 16 to achieve a range of angular adjustment relative to the central frame 12. An arrangement of holes could include a radially placed dial hole configuration and/or some other suitable arrangement of holes that would be adapted to provide angular adjustment.

Figure 5:
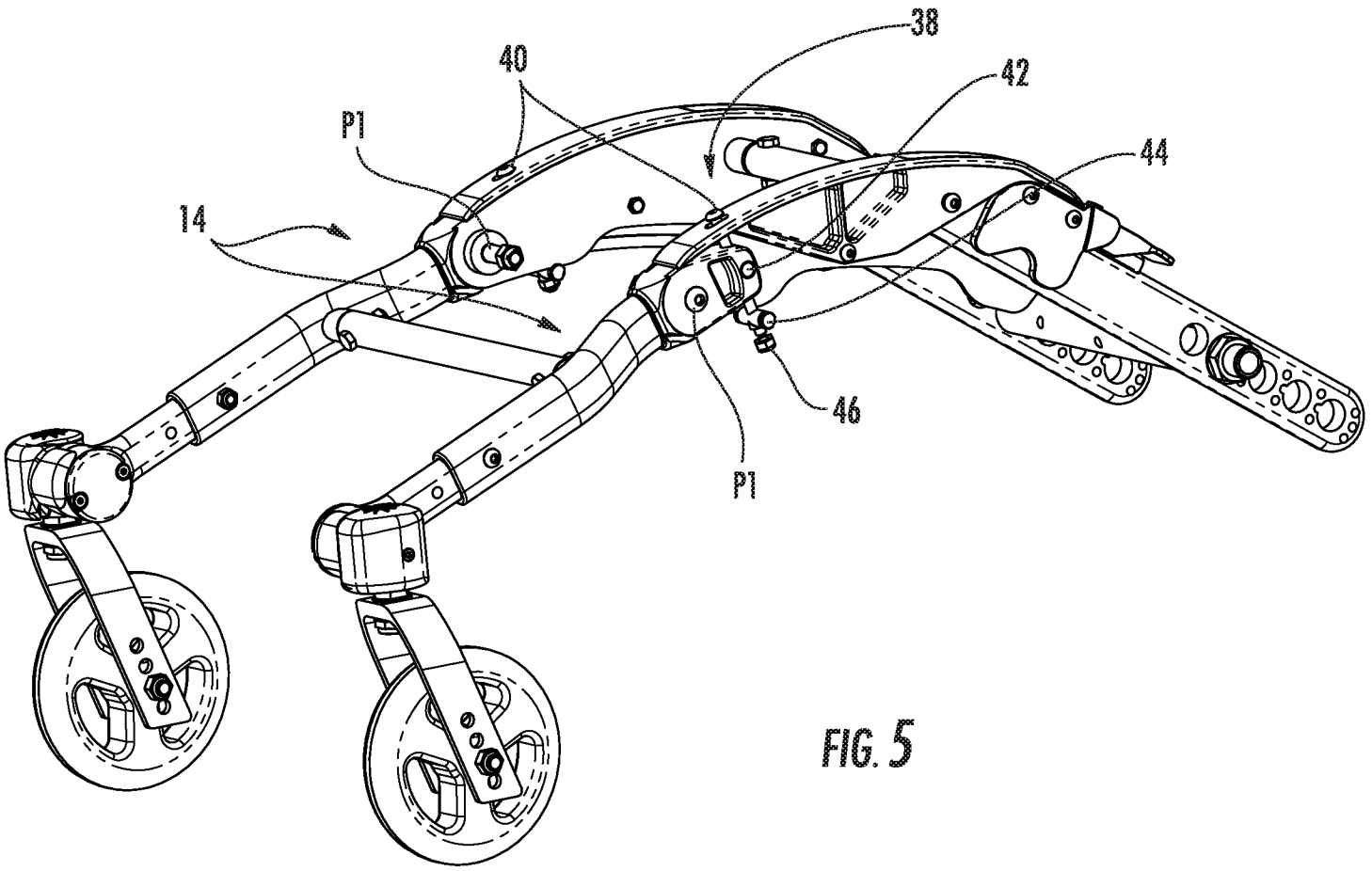
FIG. 5 is a front perspective view of the central frame with an alternative adjustment configuration for the adjustable frame components.

Incorporated into the design of the central frame 12 could be other structure and methods of angle adjustment of the front and rear frame components 14, 16, such as a screw jack system. An exemplary jack system 38 is shown in FIG. 5. Although the jack system 38 is provided for adjusting the front frame component 14, it should be appreciated that it could be similarly provided for adjusting the rear frame component 16. The illustrated jack system 38 includes a frame adjustment bolt 40 that passes through an opening in an upper portion of the plate frame cover 28 of the central frame 12. The frame adjustment bolt 40 is threaded through a cross-threaded barrel 42, which is supported for pivotal movement in relation to the front frame component 14, in particular, a front frame adjuster 72 (referenced in FIG. 7). A lower end of the frame adjustment bolt 40 passes through a frame adjustment anchor 44, which is anchored in relation to the central frame 12 (e.g., in relation to the inner and/or outer side plates 24, 26). The frame adjustment bolt 40 is rotated to adjust the angle of the front frame component 14 about the pivot point P1. An adjustment nut 46 can be tightened on the lower end of the frame adjustment bolt 40 and against the frame adjustment anchor 44 to hold the frame adjustment bolt 40, and thus, the front frame component 14, in a fixed position. An advantage of such an embodiment is that the angle adjustment could be infinite within the range of threaded engagement provided.

Figure 6:
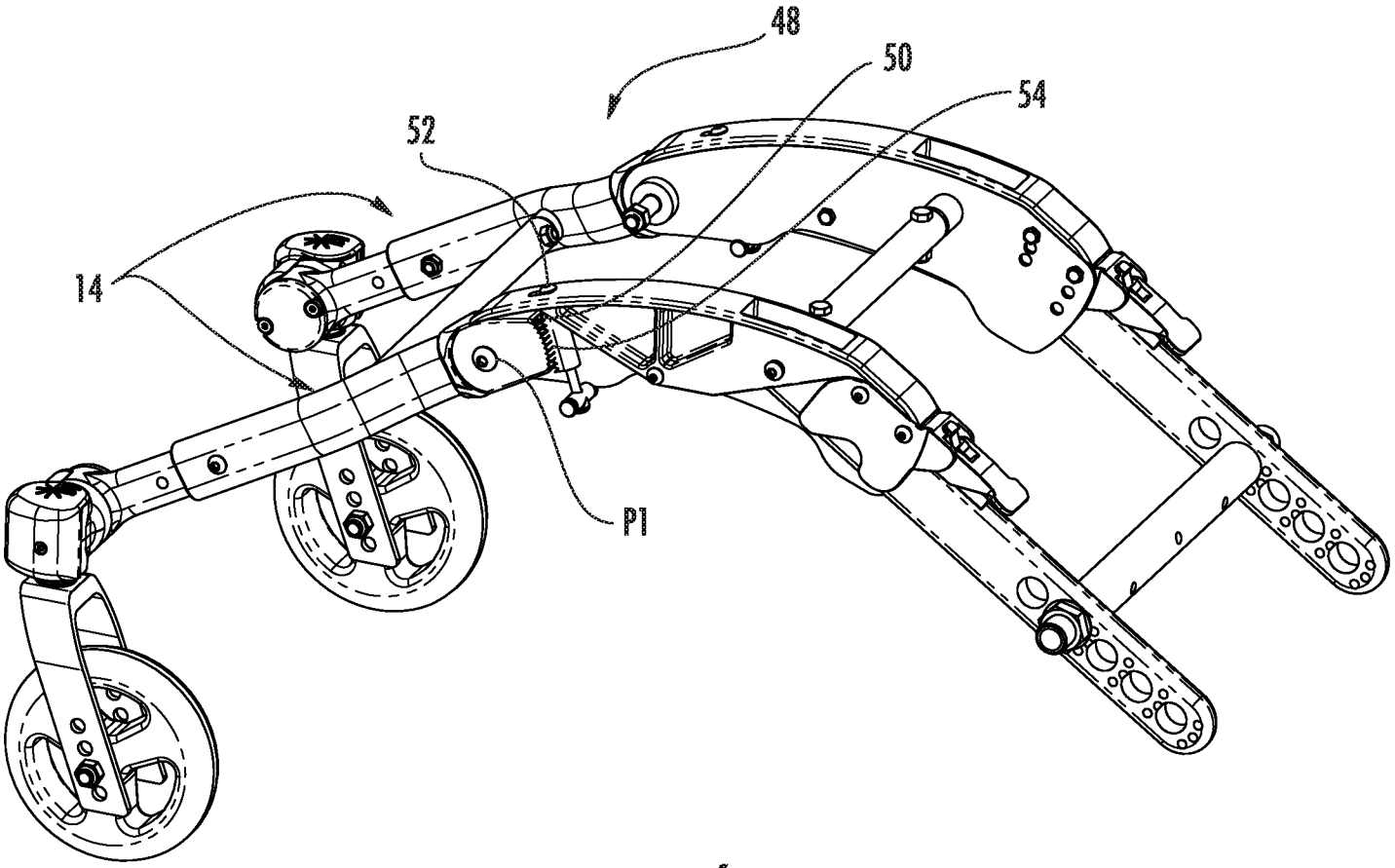
FIG. 6 is a rear perspective view of the central frame with another adjustment configuration for the adjustable frame components.

Another angle adjustment configuration may be in the form of a cam-follower or rack and pinion configuration. An exemplary rack and configuration 48 is shown in FIG. 6. Although this configuration is provided for supporting the front frame component 14, it could be similarly it could be similarly provided for adjusting the rear frame component 16. In this configuration 48, the front frame component 14, in particular, the front frame adjuster 72 (i.e., referenced in FIG. 72), functions as a pinion with teeth 50. An adjustment bolt 52 threads into a rack body (shown but not referenced). A lower end of the adjustment bolt 52 is anchored in relation to the central frame 12 (e.g., in relation to the inner and/or outer side plates 24, 26). The rack body includes teeth 54 that mesh with the pinion teeth 50. The adjustment bolt 52 is turned to screw the rack teeth 50 up and down to pivot the front frame component 14 about the pivot point P1 to change the angle of the front frame component 14.

The rear frame component 16 may be in the form of an axle saddle (referenced FIG. 2) for supporting an axle bar 56, as shown in FIG. 7. The axle bar 56 may be provided with a plurality of holes 58 (referenced in FIG. 4) that provide positioning for an axle tube 60 (i.e., along the line L1 when viewing FIG. 7) that is adapted to receive a rear wheel axle 62 (referenced in FIG. 1). This adjustment permits a further change in the height of the rear of the seat frame 22 and provides additional wheelbase adjustment in the longitudinal direction.

The wheelchair 10 may further include tubular struts 64 (shown in FIG. 7), which may be adjustable in, or interchanged with struts of, varying length (i.e., along the line W when viewing FIG. 7) to provide wheelbase adjustment in a lateral direction and to provide adjustment in width of the wheelchair 10. The axle tube 60 may be supported by a rear strut 64, or may itself be similarly adjustable in, or interchanged with axle tubes of, varying length to provide wheelbase adjustment in the lateral direction.

Figure 8:
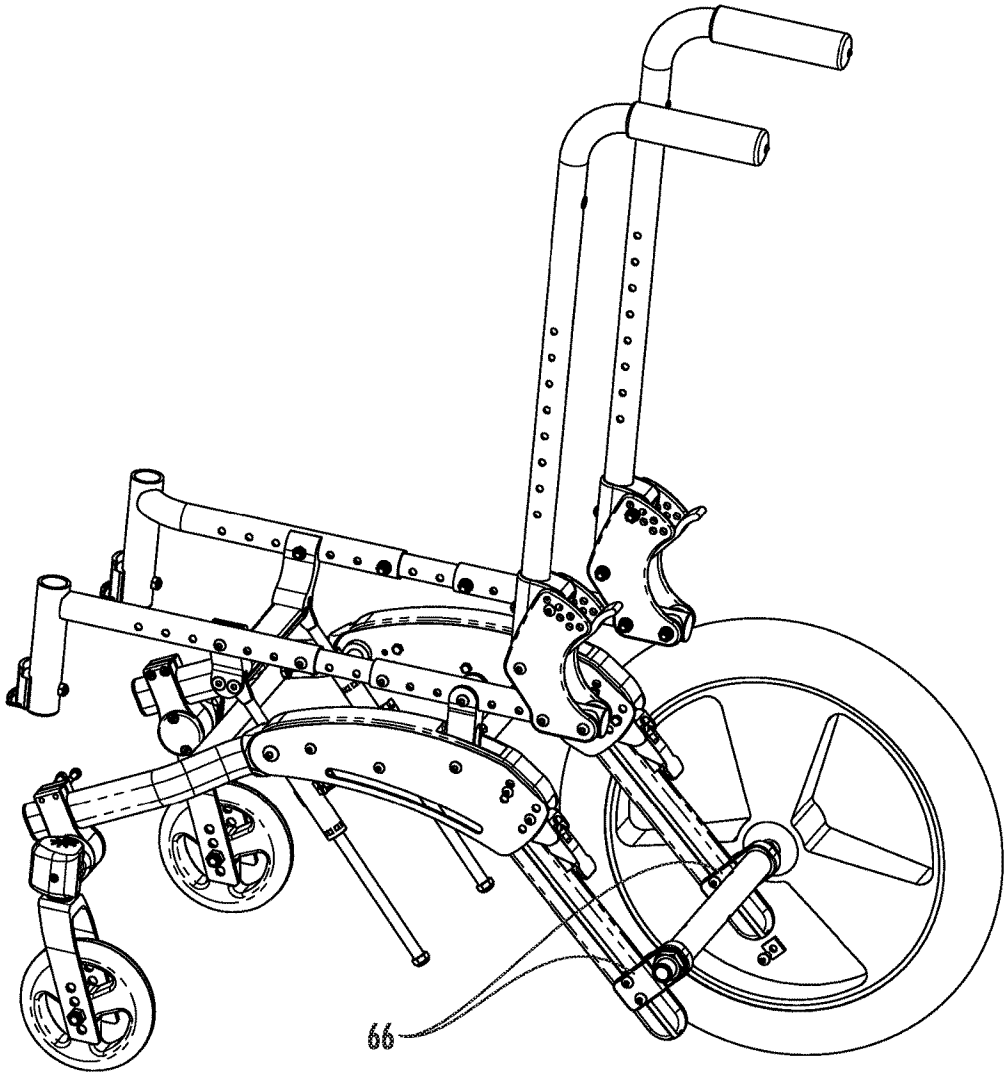
FIG. 8 is a rear perspective view of the multi-adjustable wheelchair shown in FIG. 1 with a rear wheel removed to show an alternative mounting structure for the rear wheel.
Figure 9:
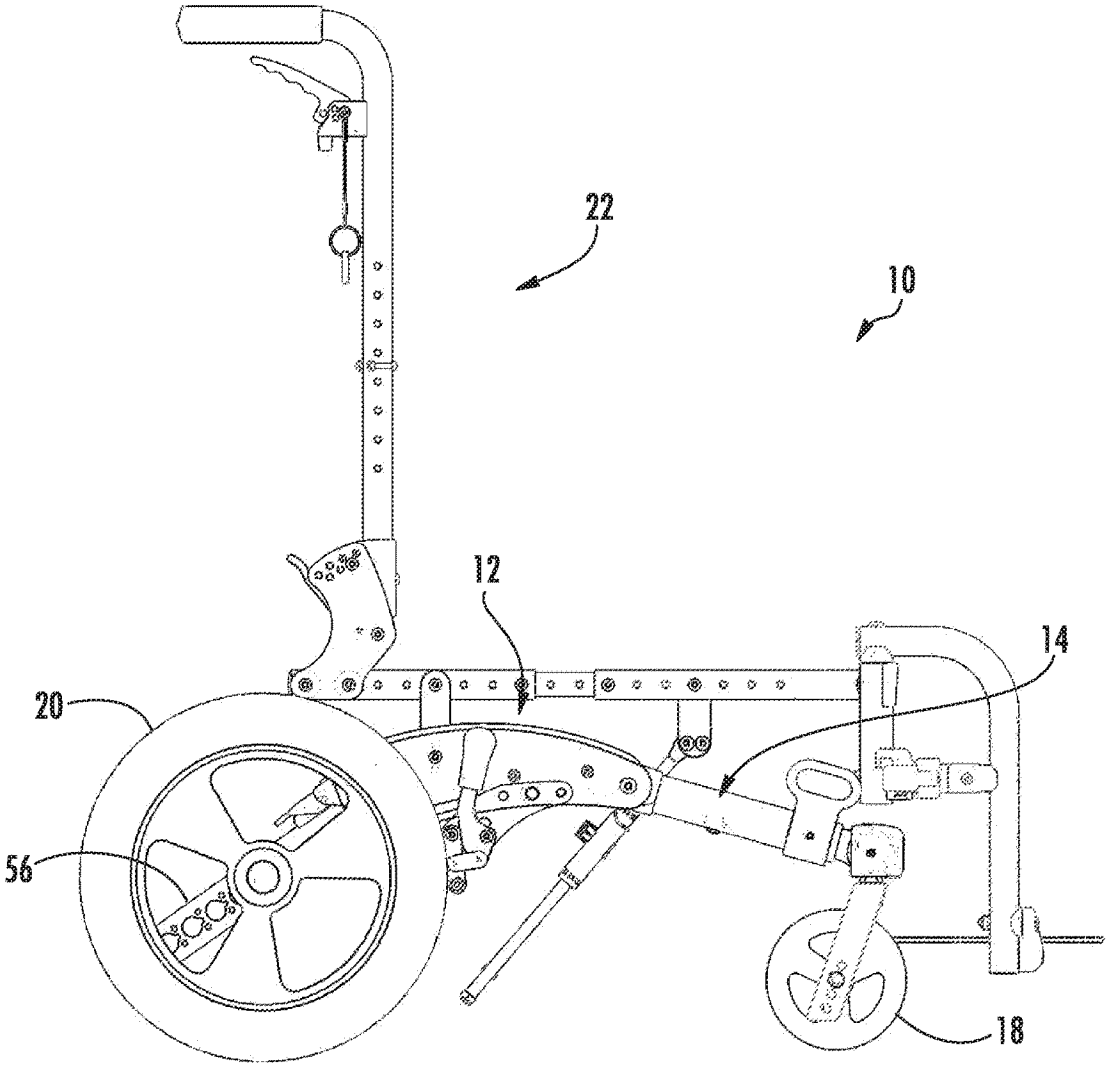
FIGS. 9-13 are side elevational views of the multi-adjustable wheelchair with rear wheels that vary in size and the adjustable frame components adjusted in various positions in relation to the central frame.
Figure 10:
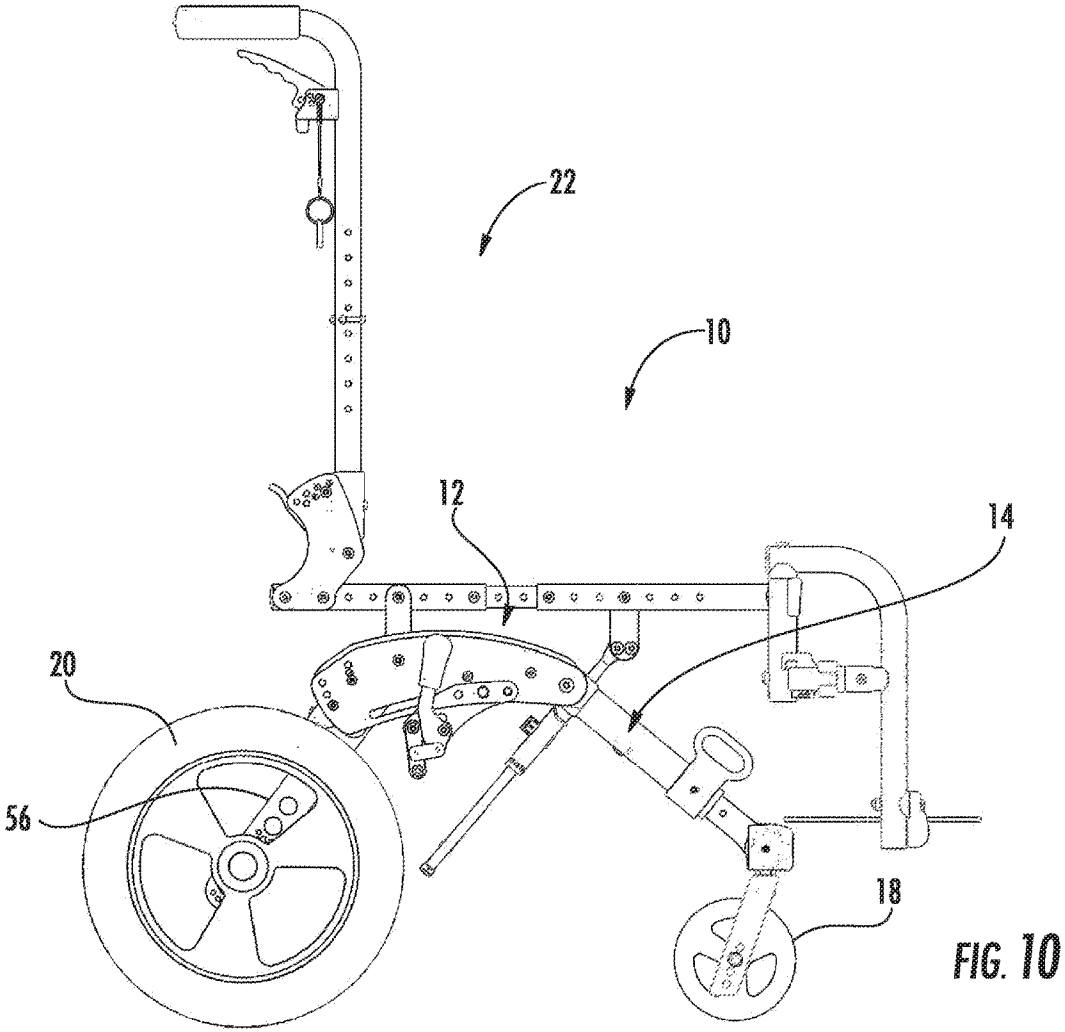
Figure 11:
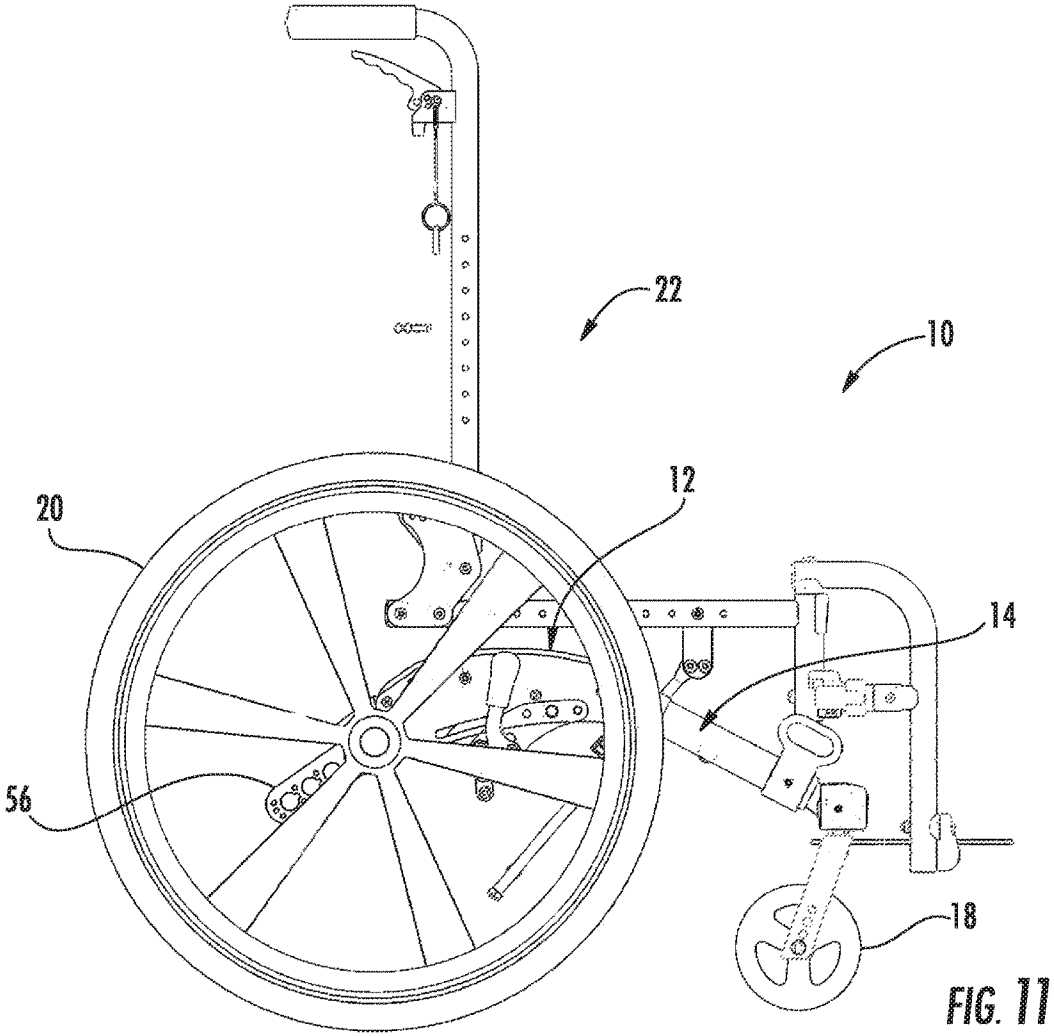
Figure 12:
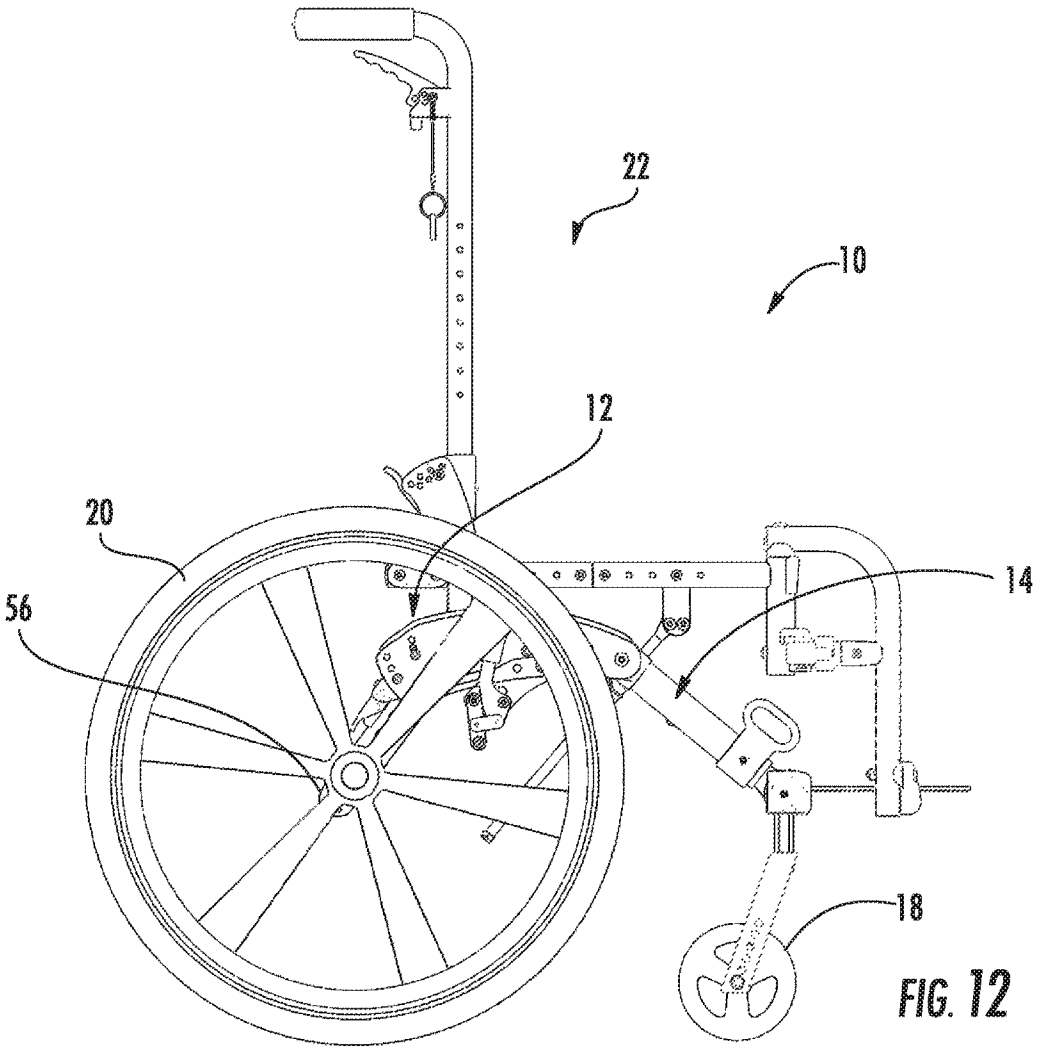
Figure 13:
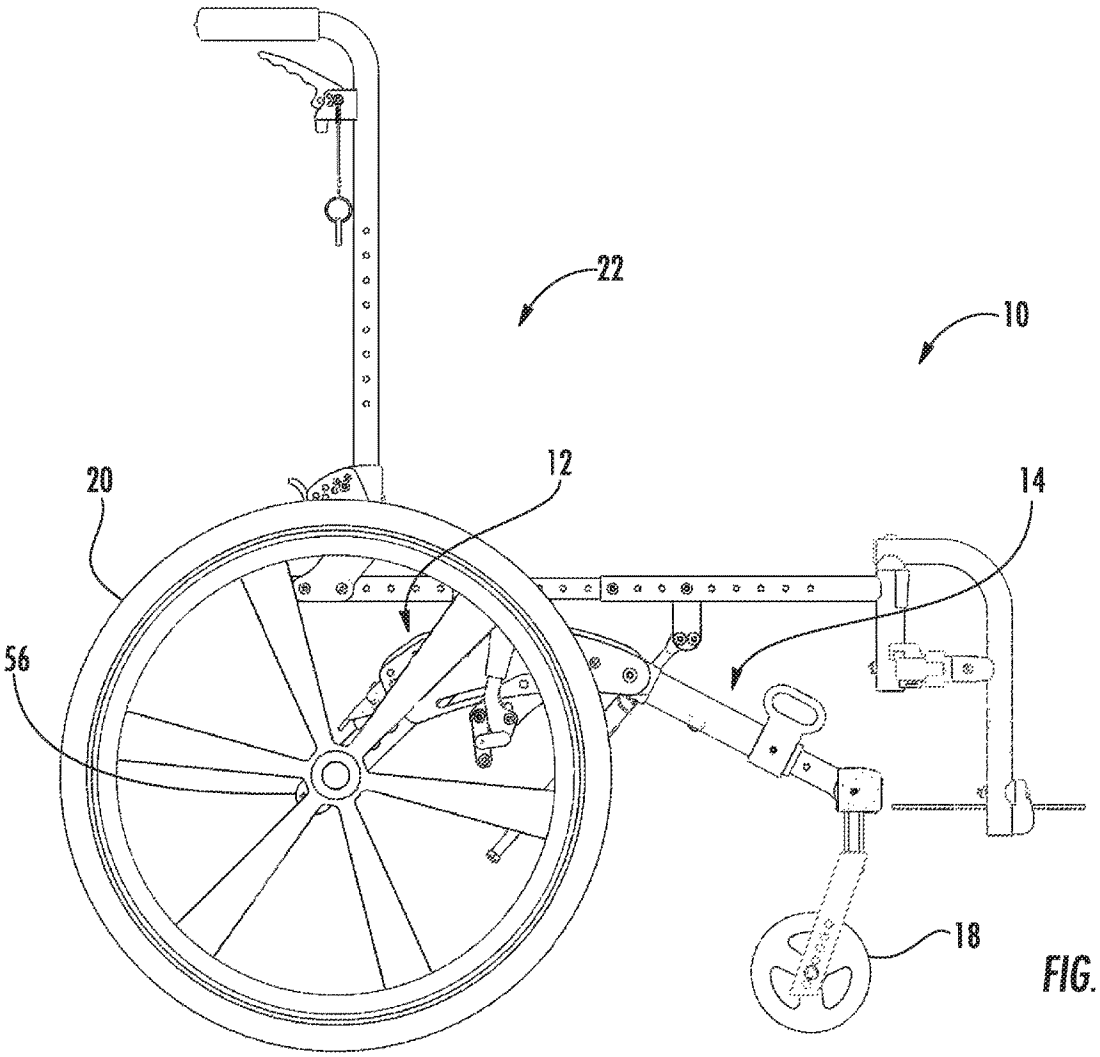

It should be understood that other axle mounting structures or axle length positioning could be provided. These may include, for example, tubular or extruded frame component with a clamped-on axle bracket or bolted-on bracket. An exemplary bracket 66 is shown in FIG. 8. This bracket 66 could be positioned in a plurality of configurations. Finer adjustments may be capable by providing such a bracket.

An exemplary front frame caster wheel support 68 is shown as coupled to a caster arm 70 that can be telescopically adjusted in length (i.e., along the line L2 when viewing FIG. 7) in relation to the front frame component 14 to permit a change in the height of the front of the seat frame 22 and provide wheelbase adjustment in the longitudinal direction. The front frame component 14 may be a tubular member for telescopically receiving a tubular front frame caster wheel support. The front frame component 14 may be supported in relation to the central frame 12 in any suitable manner, such as with the front frame adjuster 72, as shown in FIG. 7. An alternative design could use bolt-on brackets or mating profiles that couple with a plurality of holes. A caster housing 74 may be angle adjustable (i.e., along the lines A3 when viewing FIG. 7) about a central pivot P3 (shown in FIG. 7) via a radially coupled series of holes (not shown), such as the radially placed dial hole configuration, or using an angularly disassociated hole arrangement. Alternative methods for the caster housing adjustment, such as the screw adjustment or cam-follower system described above, could be employed.

Various frame configurations are shown in FIGS. 9-13, including various size rear wheels 20. It should be noted that the change in seat height and adjustment in wheelbase can be accomplished by the angular adjustment of the front and rear frame components 14, 16 (shown in FIGS. 9-10) and/or using rear wheels 20 that vary in size (shown in FIGS. 11-13).

Figure 14:
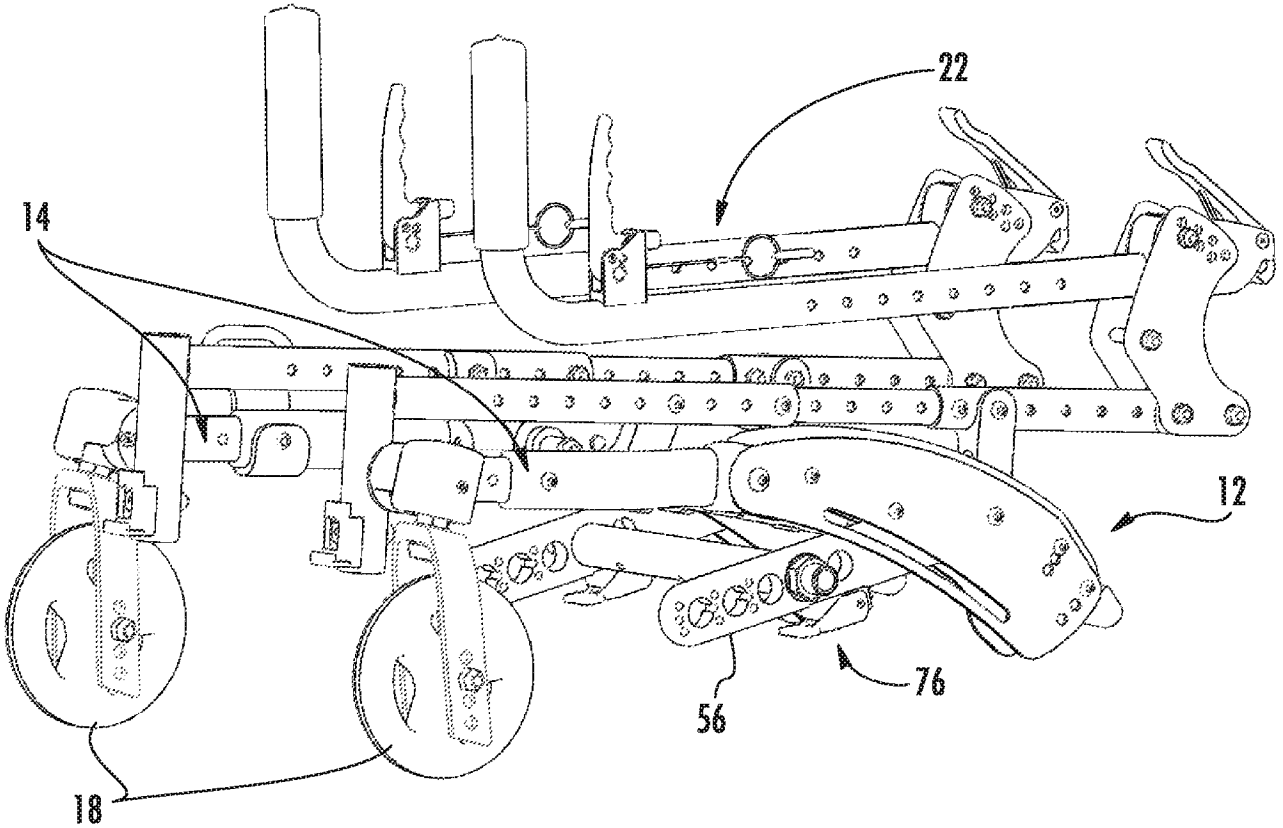
FIG. 14 is a front perspective view of the multi-adjustable wheelchair shown in FIG. 1, with the rear wheels removed and the seat frame and rear adjustable frame components pivoted and folded for compact storage.
Figure 15:
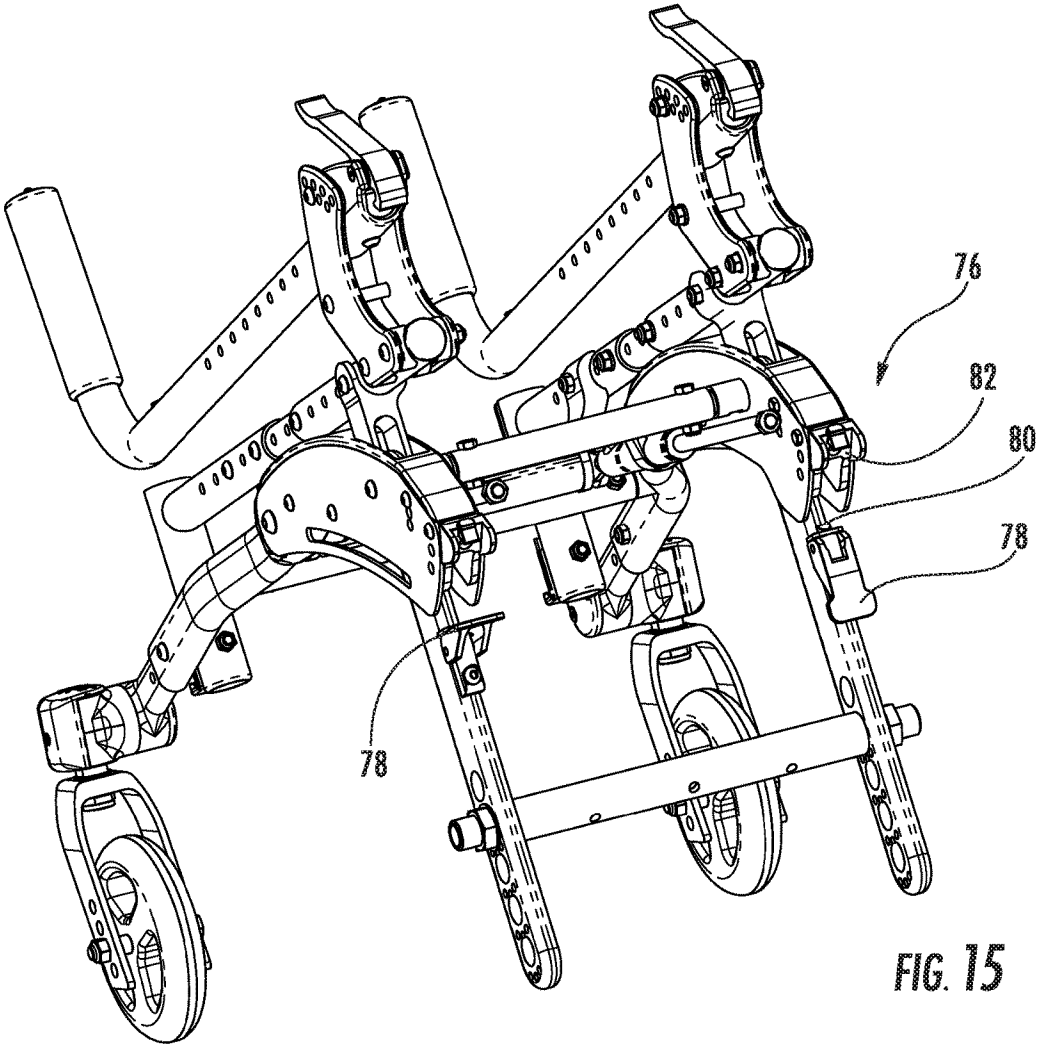
FIG. 15 is a rear perspective view of the multi-adjustable wheelchair shown in FIG. 1, further illustrating the operation of an exemplary axle bar latch mechanism.

Note that an advantage of the pivoting points P1, P2 to the adjustable front and rear frame components 14, 16 can be configured to be released in connection to the central frame 12, allowing the front and rear frame components 14, 16 to pivot and fold for compact storage, like the rear frame component 16 shown in FIG. 14. For example, the system shown may have a latch system 76 for the rear frame axle bar 32, allowing the rear frame axle bar 32 to fold forward and under the central frame 12, as shown in FIG. 14. As shown in FIG. 15, an exemplary latch system 76 may include a lever 78, which when in a locked position, allows a spring loaded axle bar lock pin 80 to engage a hole 82 in the axle bar saddle. When in an unlocked position, cam action of the lever 78 pulls the lock pin 80 back from the hole 82 in the axle bar saddle, releasing the axle bar to rotate freely to a folded position.

Figure 16:
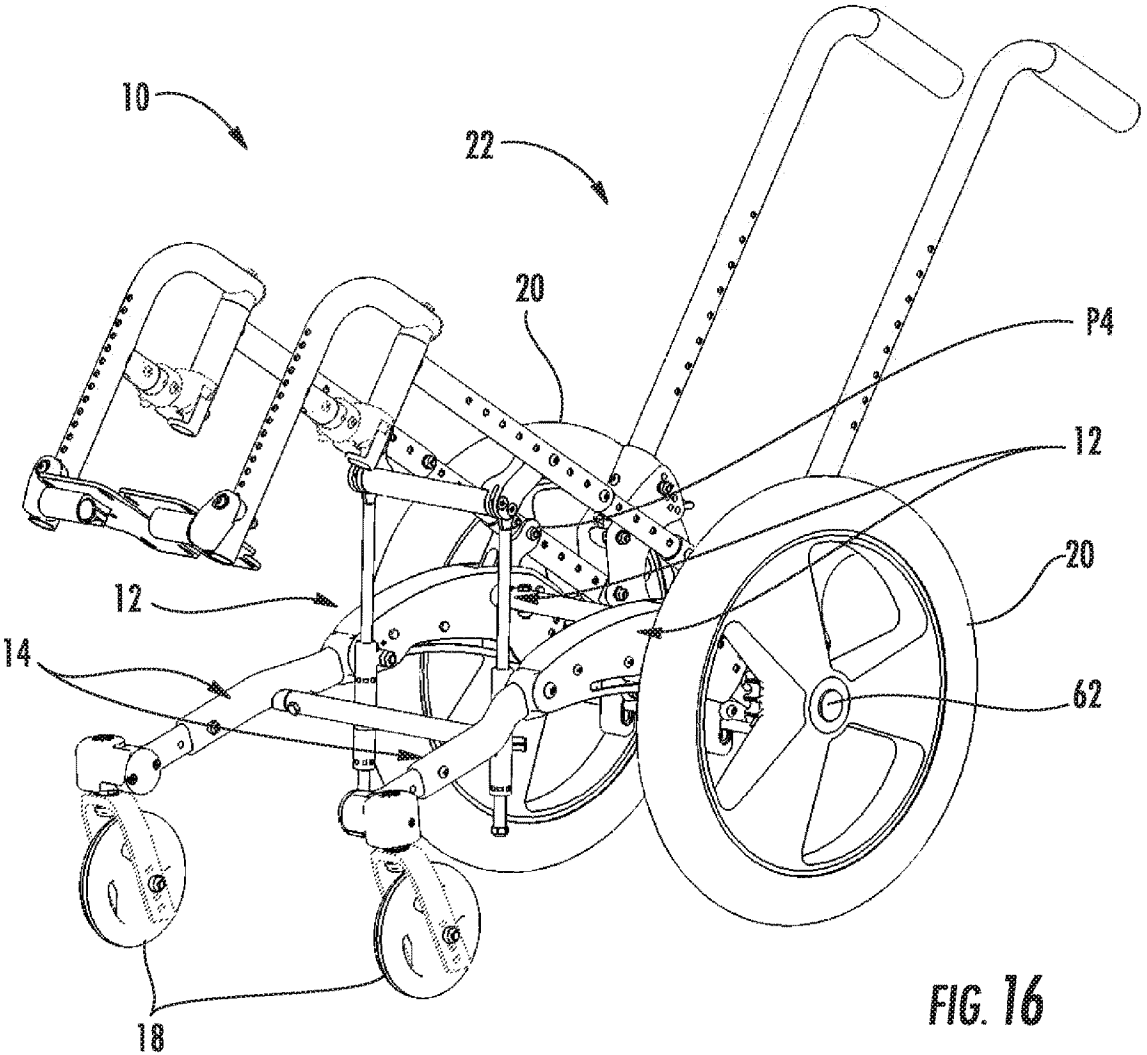
FIG. 16 is a front perspective view of the multi-adjustable wheelchair shown in FIG. 1 with a seat frame tilted.

As shown in FIG. 16, the seating frame 22 may also be tilted relative to the central frame 12 about a pivot point P4 on the central frame 12 and may be held in the tilted position using a telescopic mechanically locked rod support, known as a mechlock, which is well-known in the art. Alternative methods could be used to provide angular seat adjustment, such as a gas spring, as well as a non-tilting seat system could be used.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A multi-adjustable wheelchair comprising:

a seat frame, a central frame situated below the seat frame, a front frame component connected to the central frame for independent angular adjustment about a first pivot point in relation to the central frame, the front frame component supporting a front caster wheel, and a rear frame component connected to the central frame for independent angular adjustment about a second pivot point in relation to the central frame, the rear frame component supporting a rear wheel, wherein the independent angular adjustment of the frame components selectively provides a discrete change in height of a front portion and a rear portion of the seat frame as well as a discrete wheelbase adjustment in a lengthwise direction.

2. The wheelchair of claim 1, wherein the central frame comprises a plate system.

3. The wheelchair of claim 2, wherein the plate system comprises inner and outer frame plates and a plate frame cover.

4. The wheelchair of claim 1, further comprising:

a caster arm supported in relation to the front frame component, a front frame caster wheel support coupled to a caster arm, the front frame caster wheel support supporting the front caster wheel.

5. The wheelchair of claim 1, wherein at least one of the frame components is configured to be released in connection to the central frame, allowing the at least one frame component to pivot and fold for compact storage.

6. The wheelchair of claim 1, wherein the seating frame is configured to be tilted relative to the central frame and may be held in a tilted position.

7. A multi-adjustable wheelchair comprising:

a seat frame, a central frame situated below the seat frame, a front frame component connected to the central frame for independent angular adjustment about a first pivot point in relation to the central frame, the front frame component supporting a front caster wheel, a rear frame component connected to the central frame for independent angular adjustment about a second pivot point in relation to the central frame, the rear frame component supporting a rear wheel, wherein the independent angular adjustment of the frame components selectively provides a change in height of a front portion and a rear portion of the seat frame as well as wheelbase adjustment in a lengthwise direction, and wherein at least one of the frame components is configured to be released in connection to the central frame, allowing the at least one frame component to pivot and fold for compact storage, and a latch system comprising a lever, which when in a locked position, allows a spring-loaded bar lock pin to engage a hole to hold the at least one frame component in a use position and when in an unlocked position, cam action of the lever pulls the lock pin back from the hole, releasing the at least one frame component to rotate freely to a folded position.

* * * * *